US011773748B2

(12) United States Patent
Farabow, III et al.

(10) Patent No.: US 11,773,748 B2
(45) Date of Patent: Oct. 3, 2023

(54) HIGH TEMPERATURE FLANGE JOINT, EXHAUST DIFFUSER AND METHOD FOR COUPLING TWO COMPONENTS IN A GAS TURBINE ENGINE

(71) Applicant: Siemens Energy Global GmbH & Co. KG, Munich (DE)

(72) Inventors: John William Farabow, III, Indian Land, SC (US); William J. Curtin, Fort Mill, SC (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/597,575

(22) PCT Filed: Jun. 5, 2020

(86) PCT No.: PCT/US2020/036226
§ 371 (c)(1),
(2) Date: Jan. 12, 2022

(87) PCT Pub. No.: WO2021/021287
PCT Pub. Date: Feb. 4, 2021

(65) Prior Publication Data

US 2022/0235673 A1 Jul. 28, 2022

Related U.S. Application Data

(60) Provisional application No. 62/880,308, filed on Jul. 30, 2019.

(51) Int. Cl.
*F01D 25/24* (2006.01)
*F01D 25/30* (2006.01)

(52) U.S. Cl.
CPC ..... *F01D 25/24* (2013.01); *F01D 25/30* (2013.01); *F05D 2220/32* (2013.01); *F05D 2240/14* (2013.01)

(58) Field of Classification Search
CPC ..... F01D 25/24; F01D 25/243; F01D 25/30; F05D 2220/32; F05D 2240/14; F05D 2240/70
See application file for complete search history.

(56) References Cited

U.S. PATENT DOCUMENTS 5,090,865 A * 2/1992 Ramachandran ..... F01D 25/243 415/117
5,263,997 A 11/1993 Parker et al.
(Continued)

FOREIGN PATENT DOCUMENTS

CN 1550680 A 12/2004
CN 101493018 A 7/2009
(Continued)

OTHER PUBLICATIONS

PCT International Search Report and Written Opinion of International Searching Authority dated Sep. 17, 2020 corresponding to PCT International Application No. PCT/US2020/036226 filed Jun. 5, 2020.

*Primary Examiner* — Igor Kershteyn

(57) ABSTRACT

A high temperature flange joint in a gas turbine engine includes a first flange formed on a first component abutting a second flange formed on a second component. The flange joint includes multiple adjacently spaced bolt connections. Each bolt connection includes a first spacer plate bearing against the first flange and a second spacer plate bearing against the second flange. First and second lock washers are provided that bear against the first and second spacer plates respectively. A bolt is inserted through the first and second flanges, the first and second spacer plates and the first and second lock washers. The bolt is preloaded to clamp the first flange to the second flange. Each spacer plate has a respective thickness and is sized to enhance a bearing surface in
(Continued)

contact with the respective flange. Thereby, a bolt preload is maintained during operation of the gas turbine engine.

18 Claims, 4 Drawing Sheets

(56) References Cited

U.S. PATENT DOCUMENTS

| | | | | |
|---|---|---|---|---|
| 6,467,988 | B1 | 10/2002 | Czachor et al. | |
| 7,591,754 | B2 * | 9/2009 | Duong | F02C 7/36 475/346 |
| 11,221,066 | B2 * | 1/2022 | McCune | F16H 57/08 |
| 2003/0180140 | A1 | 9/2003 | Reigl | |
| 2004/0223846 | A1 | 11/2004 | Taylor et al. | |
| 2007/0231103 | A1 | 10/2007 | Evans et al. | |
| 2009/0185894 | A1 | 7/2009 | Kineeland et al. | |
| 2012/0219358 | A1 | 8/2012 | Reed | |
| 2014/0044539 | A1 | 2/2014 | Harada et al. | |
| 2015/0143810 | A1 | 5/2015 | Salunkhe et al. | |
| 2015/0308286 | A1 | 10/2015 | Korshikov et al. | |
| 2016/0363004 | A1 | 12/2016 | Chow et al. | |
| 2017/0108009 | A1 | 4/2017 | Obereich | |
| 2018/0202318 | A1 | 7/2018 | Fryer | |
| 2018/0209302 | A1 | 7/2018 | Gendraud et al. | |
| 2019/0093511 | A1 | 3/2019 | Nett et al. | |

FOREIGN PATENT DOCUMENTS

| | | | |
|---|---|---|---|
| CN | 103492158 | A | 1/2014 |
| DE | 102016006357 | A | 11/2017 |
| EP | 0131556 | B1 | 3/1988 |
| EP | 1795702 | A2 | 6/2007 |
| EP | 2025882 | A1 | 2/2009 |
| JP | H0610616 | A | 1/1994 |
| WO | 2009021951 | A1 | 2/2009 |

* cited by examiner

HIGH TEMPERATURE FLANGE JOINT, EXHAUST DIFFUSER AND METHOD FOR COUPLING TWO COMPONENTS IN A GAS TURBINE ENGINE

BACKGROUND

1. Field

The present disclosure relates in general to the field of gas turbine engines, and in particular a high temperature flange joint connection between adjoining parts of a gas turbine engine casing.

2. Description of the Related Art

A bolted flange joint in a gas turbine engine is typically subjected to a very high steady state temperature as well as high thermal gradients. To maintain joint integrity, it may be necessary to maintain the bolt clamp load throughout transient and steady state operation. During transient operation, the flange tends to heat up and cool faster than the bolts, which results respectively in an increase or decrease of bolt preload. When the bolt preload increases, for example, during engine startup, the flange may deform plastically. Also, creep may set in at the flange due to high steady state temperatures. The plastic deformation from engine startup and steady state may reduce the overall preload of the bolt, to the extent where there is no remaining bolt preload after engine shutdown.

SUMMARY

Briefly, aspects of the present disclosure relate to a high temperature flange joint in a gas turbine engine capable of maintain bolt preload at high steady state temperatures and transient engine operation, while minimizing deformation of the flange.

According to a first aspect, a high temperature flange joint is provided for coupling a first component to a second component in a gas turbine engine. The flange joint comprises a first flange formed on the first component abutting a second flange formed on the second component. The flange joint further comprises a plurality of adjacently arranged bolt connections. Each bolt connection is formed through a pair of mutually aligned bolt holes in the first and second flanges. Each bolt connection comprises a first spacer plate bearing against the first flange and a second spacer plate bearing against the second flange. Each bolt connection further comprises a first lock washer and a second lock washer bearing against the first spacer plate and the second spacer plate respectively. Each bolt connection further comprises a bolt inserted through the first and second flanges, the first and second spacer plates and the first and second lock washers, the bolt being preloaded to clamp the first flange to the second flange. Each of the spacer plates has a respective thickness and being sized to enhance a bearing surface in contact with the respective flange, whereby a bolt preload is maintained during operation of the gas turbine engine.

According to a second aspect, a method is provided for coupling a first component to a second component in a gas turbine engine. The method comprises forming a plurality of adjacently arranged bolt connections. Each bolt connection is formed through a pair of mutually aligned bolt holes respectively in a first flange of the first component and a second flange of the second component. Forming each bolt connection comprises disposing a first spacer plate bearing against the first flange and a second spacer plate bearing against the second flange. Forming each bolt connection further comprises disposing a first lock washer and a second lock washer bearing against the first spacer plate and the second spacer plate respectively. Forming each bolt connection further comprises inserting a bolt through the first and second flanges, the first and second spacer plates and the first and second lock washers. Forming each bolt connection further comprises preloading the bolt to clamp the first flange to the second flange. Each of the spacer plates has a respective thickness and is sized to enhance a bearing surface in contact with the respective flange, whereby a bolt preload is maintained during operation of the gas turbine engine.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the various embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
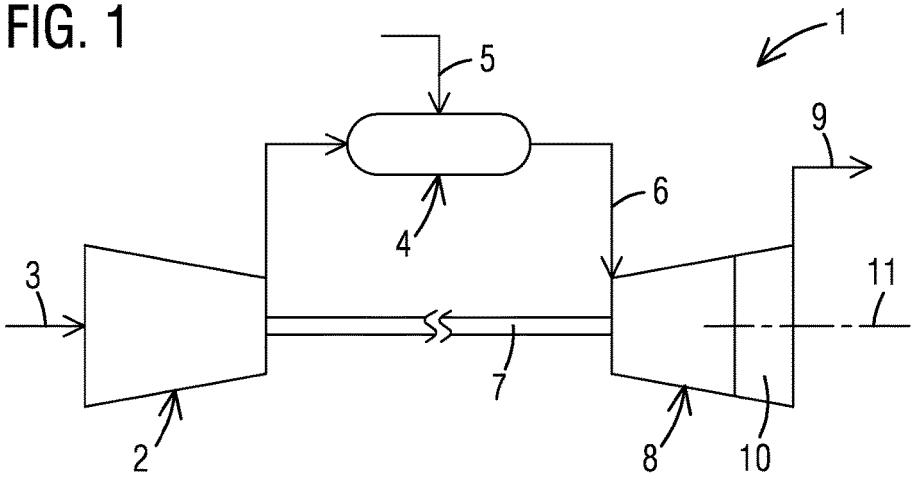
FIG. 1 is a schematic view of a gas turbine engine.

Referring to FIG. 1, a gas turbine engine 1 generally includes a compressor section 2, a combustor section 4, and a turbine section 8. In operation, the compressor section 2 inducts ambient air 3 and compresses it. The compressed air from the compressor section 2 enters one or more combustors in the combustor section 4. The compressed air is mixed with the fuel 5, and the air-fuel mixture is burned in the combustors to form a hot working medium fluid 6. The hot working medium fluid 6 is routed to the turbine section 8 where it is expanded through alternating rows of stationary turbine vanes and rotating turbine blades and used to generate power that can drive a rotor 7. The expanded working medium fluid 9 is exhausted from the engine 1 via an exhaust diffuser 10 of the turbine section 8, which is located downstream of a last row of turbine blades.

Figure 2:
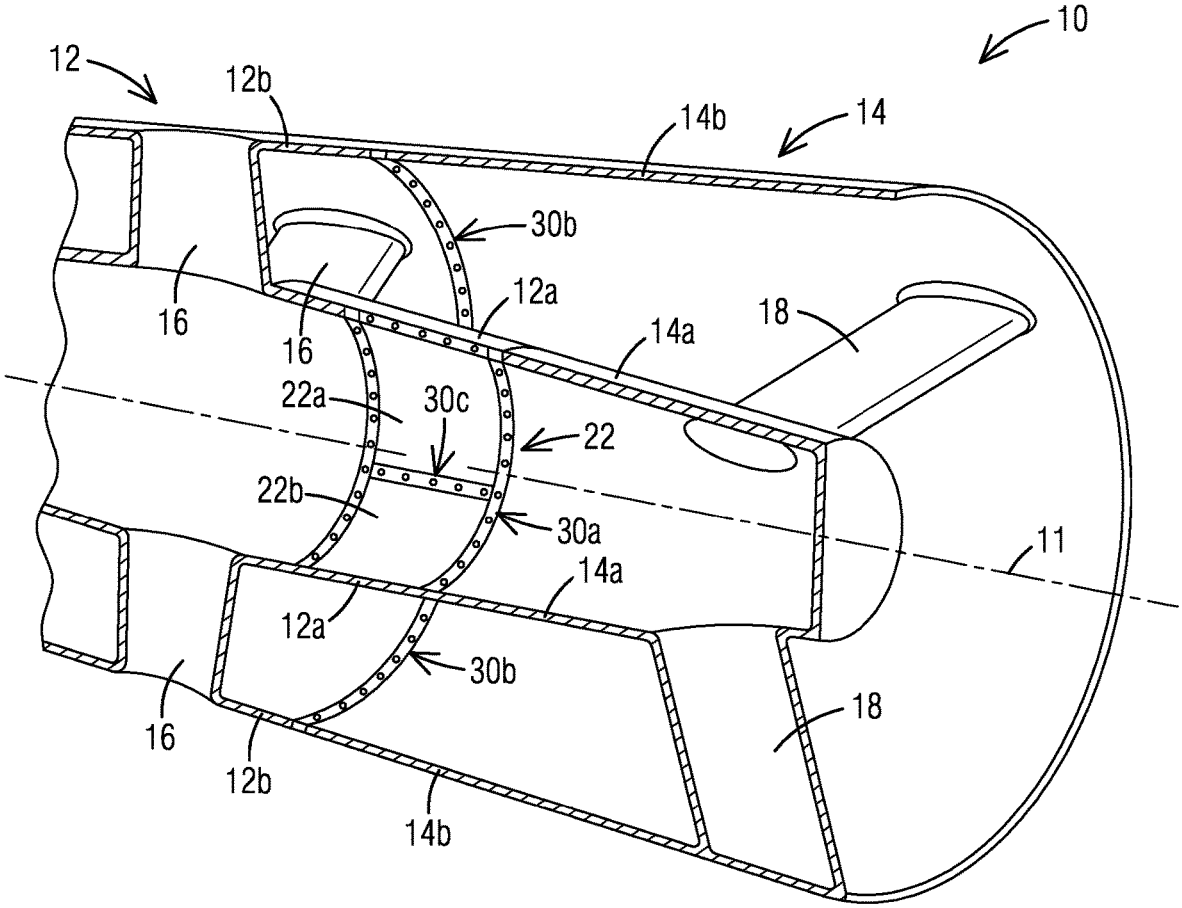
FIG. 2 is a perspective sectional view of a portion of a turbine exhaust diffuser where aspects of the present disclosure may be incorporated.

Aspects of the present disclosure may be used to form a high temperature flange joint at various locations in the gas turbine engine 1. A particularly suitable implementation of the disclosed embodiments is in the exhaust diffuser 10. A portion of an example exhaust diffuser 10 is shown in FIG. 2. In the shown embodiment, the exhaust diffuser 10 has an axis 11 and comprises an exhaust cylinder 12 located downstream of a last stage of turbine blades (not shown) and an exhaust manifold 14 coupled axially to and downstream of the exhaust cylinder 12. Each of the exhaust cylinder 12 and the exhaust manifold 14 includes a respective annular ID wall 12*a*, 14*a*, and a respective annular OD wall 12*b*, 14*b*. The ID walls 12*a*, 14*a* and the OD walls 12*b*, 14*b* respectively form an ID boundary and an OD boundary of an annular turbine exhaust flow path. A plurality of load bearing struts 16 are circumferentially arranged in the exhaust flow path of the exhaust cylinder 12, extending through the ID wall 12*a* and the OD wall 12*b*. A plurality of load bearing struts 18 may also be circumferentially arranged in the exhaust flow path of the exhaust manifold 14, extending through the ID wall 14*a* and the OD wall 14*b*.

The exhaust cylinder 12 and the exhaust manifold 14 may be coupled by one or more annular flange joints. For example, a first annular flange joint 30*a* may be formed between the ID wall 12*a* of the exhaust cylinder 12 and the ID wall 14*a* of the exhaust manifold 14. A second flange joint 30*b* may be formed between the OD wall 12*b* of the exhaust cylinder 12 and the OD wall 14*b* of the exhaust manifold 14. Aspects of the present disclosure may be applied to either or both of the annular flange joints 30*a* and 30*b*. Aspects of the present disclosure may also be applied to linear flange joints, for example the joints 30*c* for tangentially coupling adjacent segments 22*a*, 22*b* of a bearing axis panel 22. Without limitation, the joints in an exhaust diffuser may be exposed to local temperatures around 700-800 degrees Celsius.

A flanged joint comprises a plurality of bolt connections through abutting flanges formed on the components to be coupled. In case of an annular flange joint, such as joints 30*a*, 30*b* herein, the bolt connections are adjacently arranged along a circumferential direction. In case of a linear flange joint, such as joints 30*c* herein, the flanges extend lengthwise in an axial direction of the engine 1, wherein the bolt connections are adjacently arranged in a straight line along the axial direction.

In view of the challenges associated with a high temperature flange joint in a gas turbine engine, as noted in the "Background" section of this specification, an approach for reducing the contact pressure under the washer face may be to use an oversized washer, having a larger outer diameter. In this application, however, an oversized washer typically requires the pitch circle diameter of the bolt to be increased to package the oversized washer accordingly. This would necessitate an increase in flange height, which may have a negative effect on flange fatigue life, since a taller flange results in a larger thermal gradient in a high temperature environment, such as in an exhaust diffuser. Another approach to address the stated problem may involve using low bolt preload values at assembly. However, this may potentially lead to field issues with bolt loosening, particularly during engine shutdown. The problem is further pronounced in advanced engines having higher ramp rates and exhaust temperatures.

Figure 3:
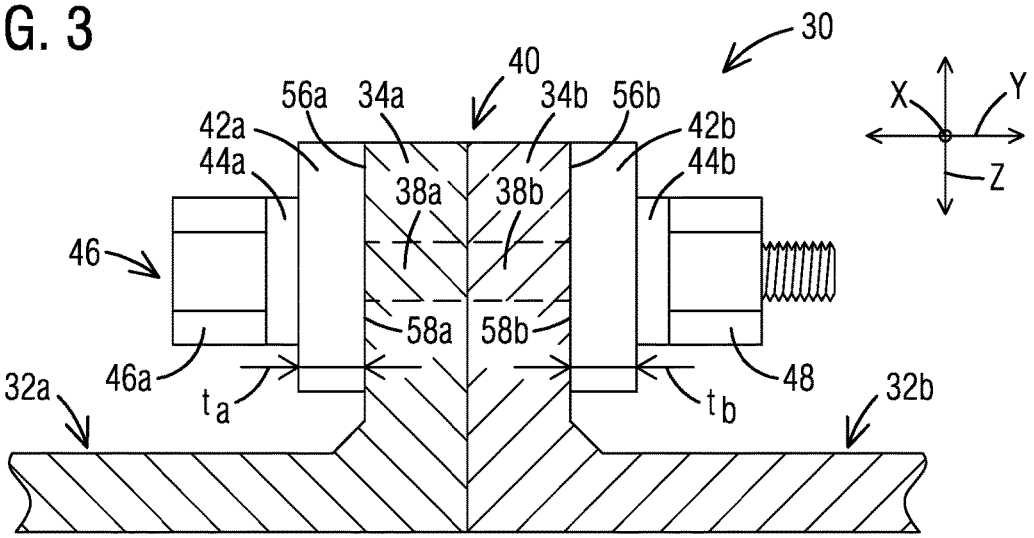
FIG. 3 is a sectional view of a high temperature flange joint.

FIG. 3 depicts a high temperature flange joint 30 for coupling a first component 32*a* to a second component 32*b* in a gas turbine engine, according to an embodiment of the present disclosure. The flange joint 30 may, for example and without limitation, be embodied as any of the flange joints 30*a*, 30*b*, 30*c* shown in FIG. 2. The first component 32*a*, may represent, for example, either of the components 12*a*, 14*a*, 22*a*, while the component 32*b* may correspondingly represent any of the components 12*b*, 14*b*, 22*b*. In this specification, the axes X, Y, and Z respectively represent a length direction, a thickness direction and a height direction of the flange joint. The length direction refers to a direction along which bolt connections are arranged. For the flange joints 30*a*, 30*b*, the length direction corresponds to a circumferential direction of the gas turbine engine, while for the flange joint 30*c*, the length direction corresponds to an axial direction of the gas turbine engine. The thickness direction refers to a direction of extension of the bolts. The height direction is perpendicular to the length and thickness directions. In case of the flange joints 30*a*, 30*b*, 30*c*, the height direction corresponds to a radial direction of the gas turbine engine.

As shown in FIG. 3, the first component 32*a* has a respective flange 34*a* formed thereon, while the second component 32*b* has a respective flange 34*b* formed thereon. The flanges 34*a*, 34*b* each have an array of bolt holes formed therethrough, respectively denoted as 38*a* and 38*b*. The array of bolt holes 38*a*, 38*b* extend along the length direction of the flange joint 30, which is perpendicular to the plane of FIG. 3. At the time of assembly of the components 32*a*, 32*b*, the flanges 34*a*, 34*b* abut such that the bolt holes 38*a*, 38*b* on the respective flanges 34*a*, 34*b* are mutually aligned. The flange joint 30 includes a plurality of bolt connections 40 arranged adjacently along the length direction, each bolt connection 40 being formed through a pair of mutually aligned bolt holes 38*a*, 38*b* in the first and second flanges 34*a*, 34*b*. Each bolt connection 40 comprises a first spacer plate 42*a* bearing against the first flange 34*a* and a second spacer plate 42*b* bearing against the second flange 34*b*. Each bolt connection further comprises a first lock washer 44*a* and a second lock washer 44*b* bearing against the first spacer plate 42*a* and the second spacer plate 42*b* respectively. A bolt 46 is inserted through the first and second flanges 34*a*, 34*b*, the first and second spacer plates 42*a*, 42*b* and the first and second lock washers 44*a*, 44*b*. The bolt 46 is preloaded, herein by tightening a respective nut 48 by applying an appropriate torque, to clamp the first flange 34*a* to the second flange 34*b*. Each of the spacer plates 42*a*, 42*b* has a respective thickness $t_a$, $t_b$. Each spacer plate 42*a*, 42*b* is further sized to enhance a bearing surface in contact with the respective flange 34*a*, 34*b*. In one embodiment, each of the spacer plates 42*a*, 42*b* may be sized such that a bearing surface 56*a*, 56*b* of the spacer plate 42*a*, 42*b* substantially covers a bearing face 58*a*, 58*b* of the respective flange 34*a*, 34*b* along a length L of the spacer plate 42*a*, 42*b*.

As per the described embodiment, the bearing area of contact with the flanges 34*a*, 34*b* is significantly increased over what can be achieved by an oversized washer, without increasing the height of the flanges 34*a*, 34*b*. This reduces flange thermal gradients and improves component fatigue life. Increased bearing area results in reduced contact pressure, which, in turn, reduces creep deformation of the flanges 34*a*, 34*b* and loss of bolt preload. This obviates the need for high grade flange materials, such as nickel alloys, and allows low strength materials, such as austenitic stainless steel to be used in the flanges. In one embodiment, the flanges 34*a*, 34*b* may thereby be formed of a material having a lower yield strength than a material of the spacer plates 42*a*, 42*b*. An additional benefit is achieved by the thickness of the spacer plates 42*a*, 42*b*. Since the bolt preload extends below the washers 44*a*, 44*b*, through the spacer plates 42*a*,

42*b* in a conical distribution, the thicker the spacer plates 42*a*, 42*b*, the larger the pressure distribution on the flanges 34*a*, 34*b*. Furthermore, due to the thickness of the of the spacer plates 42*a*, 42*b*, the bolt head 46*a* is located further away from the flanges 34*a*, 34*b*, whereby bolt temperature is lowered. The decreased bolt temperatures allow use of lower grade bolt material. The shown configuration maintains bolt preload for a longer duration during operation of the gas turbine engine, which extends the service interval to which the bolts must be retightened. The shown configuration requires an increased bolt length, which increases the bolt length to diameter ratio without increasing flange thickness. This allows for additional bolt stretch, which reduces the preload loss due to settling without affecting the flange fatigue life.

In some embodiments, to reduce thermal loading, the flanges 34*a*, 34*b* may have a scalloped profile along the length direction (see FIG. 4-7). The scalloped profile may include first portions 52 having a first height $h_1$ separated by second portions 54 having a second height $h_2$, the first height $h_1$ being greater than the second height $h_2$. Herein, the bolts 46 are located at the first portions 52 of the scalloped profile having increased height. In other embodiments, the flanges 34*a*, 34*b* may be provided with a flat profile, having substantially constant height along the length direction.

In one embodiment, the lock washers 44*a*, 44*b* are configured to secure the bolts 46 in position by utilizing the bolt preload. One example of such a lock washer is a bipartite wedge lock washer. The construction of a bipartite wedge lock washer is known to one skilled in the art, for example as disclosed in the patent document EP0131556B1. The use of the above-mentioned type of lock washers is particularly enabled by the herein described embodiment that is configured to substantially maintain bolt preload during engine operation. The use of such lock washers in a high temperature flange joint would provide significant reduction in complexity and time of assembly in relation to conventionally used lock washers in such applications, such as tab or pant-leg lock washers, which are positively locked to a surface and are difficult and time-consuming to bend during assembly.

To prevent loss of bolt preload and maintain functionality of the lock washers 44*a*, 44*b* during engine operation, a further development consists in providing an anti-rotation feature to the spacer plates 42*a*, 42*b* so that they do not rotate relative to the respective flange 34*a*, 34*b*, for example, in the event the bolt 46 loosens.

Figure 4:
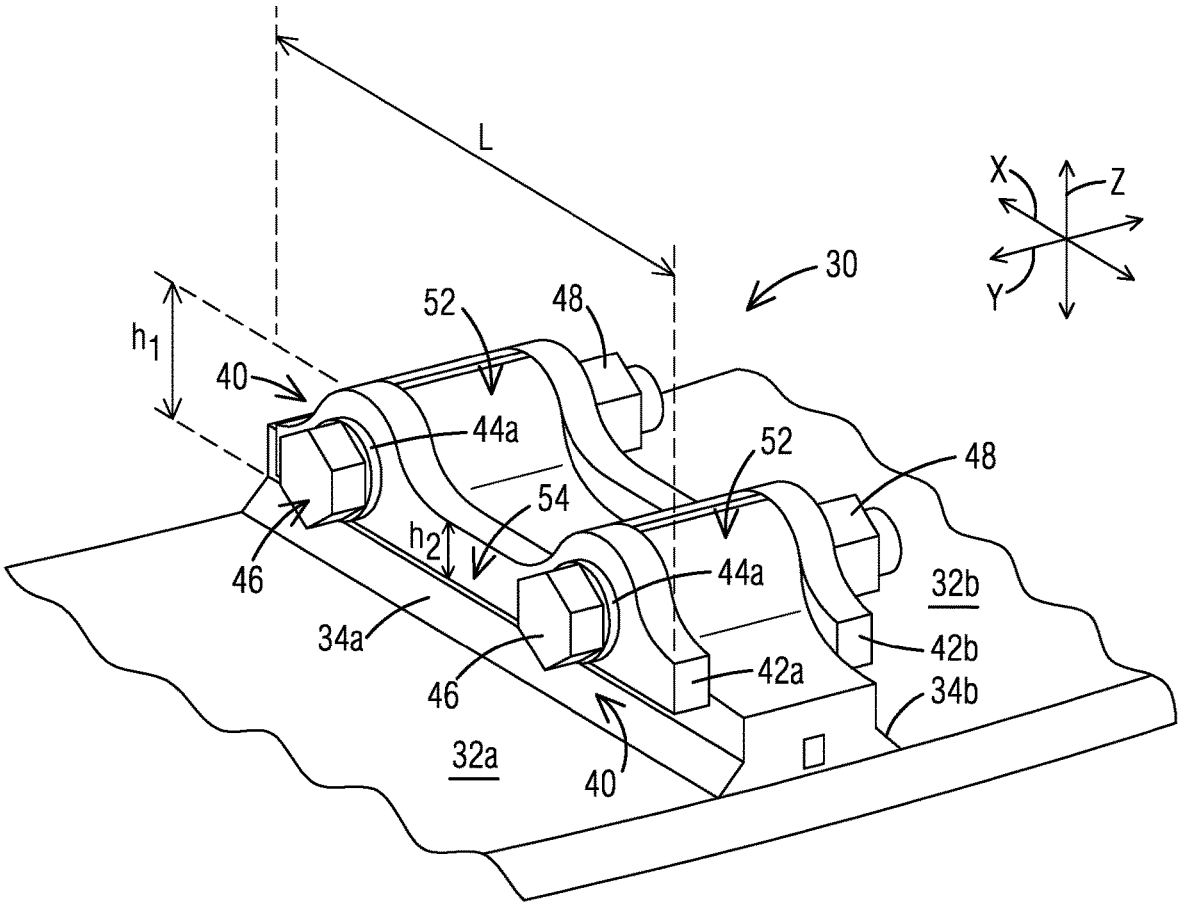
FIG. 4 is a perspective view of a high temperature flange joint with spacer plates with anti-rotation feature, according to one embodiment.

As shown in FIG. 4, one way to achieve an anti-rotation feature is by sizing the spacer plates 42*a*, 42*b* in the length direction, to accommodate multiple adjacent bolts 46 therethrough. In the shown example, each spacer plate 42*a*, 42*b* is sized to extend to two adjacent bolt holes. By extending each spacer plate 42*a*, 42*b* across adjacent bolts 46, it may be ensured that if one of the bolts 46 rotates counter-clockwise to loosen, the adjacent bolt 46 on the same spacer plate rotates clockwise to tighten, thereby preventing rotation of the spacer plate. The lengthwise size of the spacer plates 42*a*, 42*b* may be constrained based on the consideration that with increasing length, thermal lag may develop between the spacer plate 42*a*, 42*b* and the respective flange 34*a*, 34*b* that can lead to additional loading on the bolts 46 in the length direction.

Figure 5:
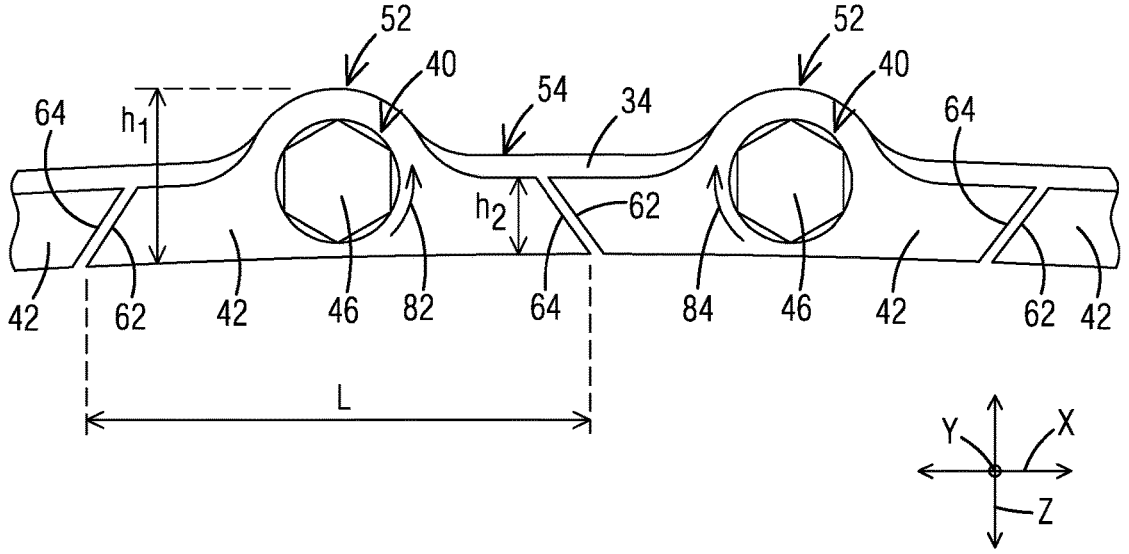
FIG. 5 depicts an end view of a high temperature flange joint having spacer plates with anti-rotation feature incorporating beveled interfaces, according to another embodiment.
Figure 6:
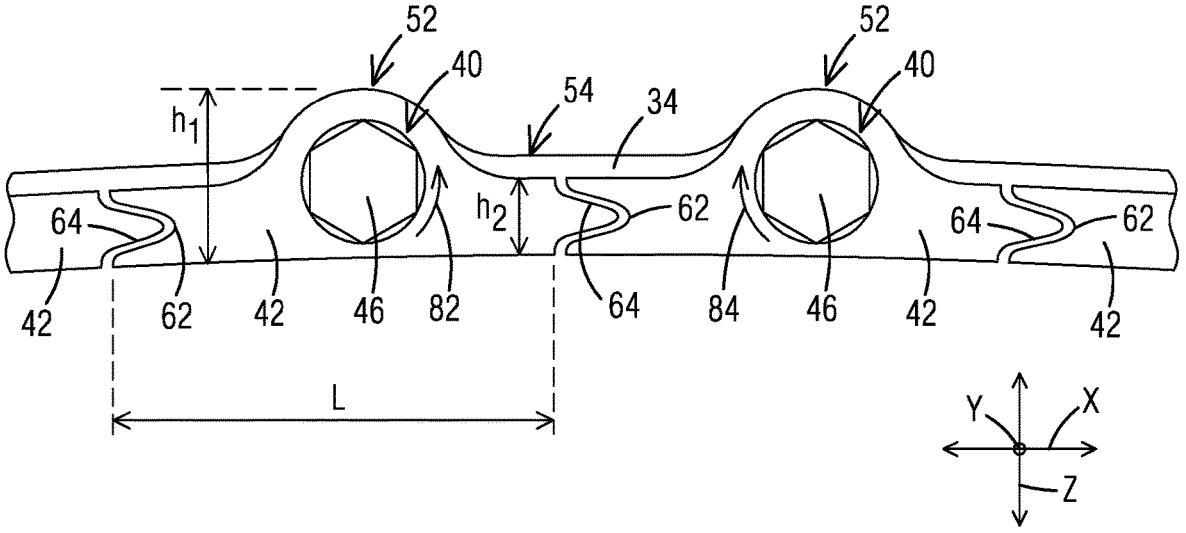
FIG. 6 depicts an end view of a high temperature flange joint having spacer plates with anti-rotation feature incorporating interlocking interfaces, according to yet another embodiment.

FIGS. 5 and 6 illustrate example embodiments which provide an anti-rotation feature while minimizing thermal lag between the spacer plates 42*a*, 42*b* and the respective flange 34*a*, 34*b*. In these example embodiments, each spacer plate 42 (generically referring to either of the spacer plates 42*a*, 42*b*) may be sized lengthwise to accommodate a single bolt 46. As shown in FIGS. 5 and 6, each spacer plate 42 extends lengthwise along the respective flange 34 (generically referring to either of the flanges 34*a*, 34*b*) from a first edge 62 to a second edge 64. The interfacing edges 62 and 64 of adjacent spacer plates may be configured to prevent rotation of the spacer plate 42 in relation the flange 34.

In the embodiment of FIG. 5, the first edge 62 and the second edge 64 of each spacer plate 42 are beveled, i.e., inclined at an angle that is non-parallel and non-orthogonal to the length direction. The beveled edges 62, 64 of one spacer plate 42 are configured to interface with beveled edges 64, 62 of adjacent spacer plates 42 on opposite sides. The bevel is at an angle such that if one of the spacer plates 42 were to rotate counter-clockwise (for example, due to bolt loosening) as shown by the arrow 82, then it would create a clockwise rotation (bolt tightening) on the adjacent bolts on either side, as shown by the arrow 84. This would prevent the spacer plate 42 that is loosening from rotating further, thereby realizing an anti-rotation feature. To that end, in the shown configuration of FIG. 5, the first edge 62 and the second edge 64 of each spacer plate 42 may be beveled in opposite directions.

In the embodiment of FIG. 6, a similar effect is achieved by providing a gear-tooth or interlocking interface between adjacent spacer plates 42. Herein, a first edge 62 of each spacer plate 42 defines a groove shape and the second edge 64 of the spacer plate 42 defines a tongue shape. The first edge 62 and the and second edge 64 are configured to form respective interlocking interfaces with tongue and groove shaped edges 64, 62 of adjacent spacer plates 42 on opposite sides. The interlocking interfaces ensure that if one of the spacer plates 42 were to rotate counter-clockwise (for example, due to bolt loosening) as shown by the arrow 82, then it would create a clockwise rotation (bolt tightening) on the adjacent bolts on either side, as shown by the arrow 84.

Figure 7:
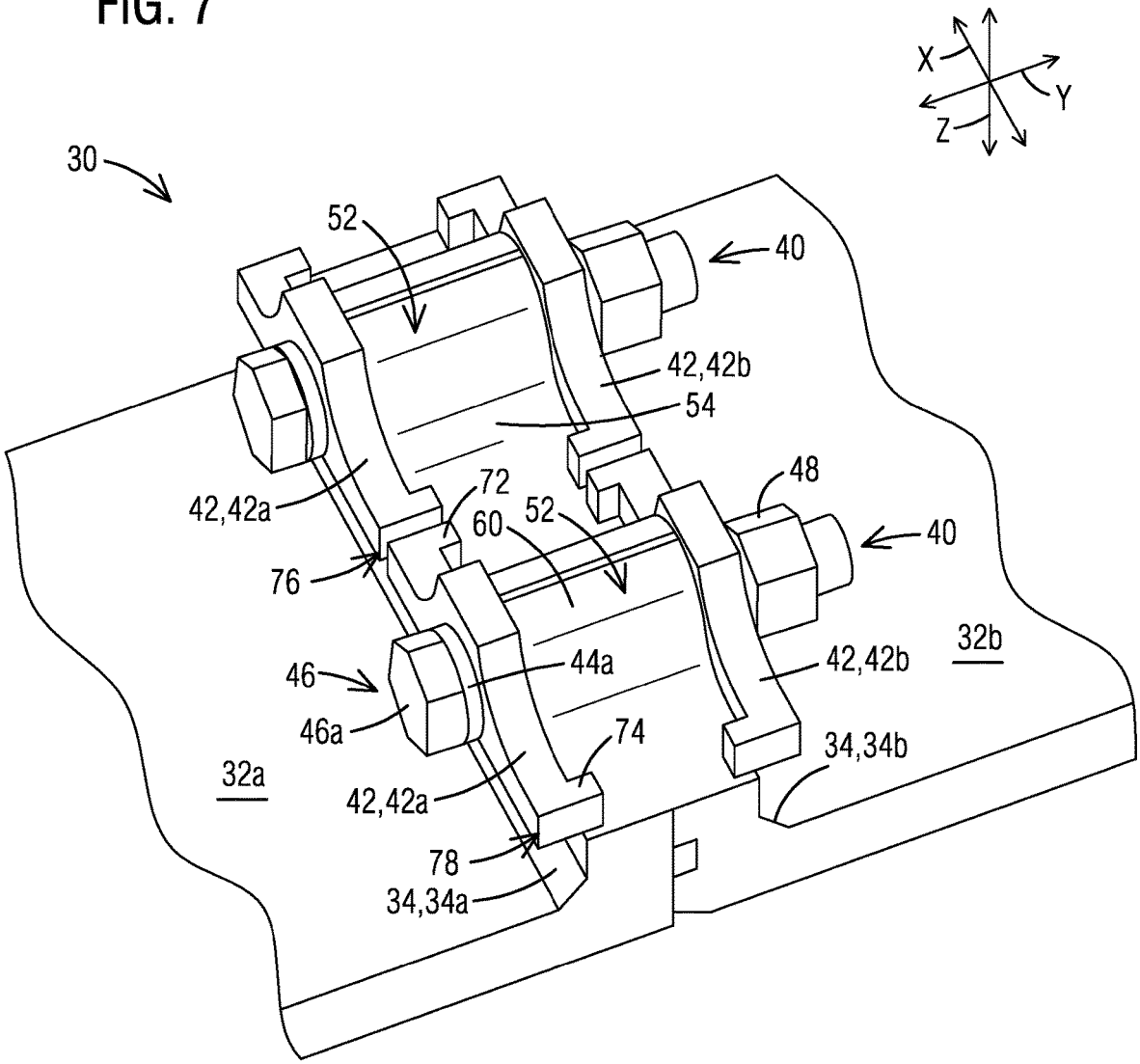
FIG. 7 is a perspective view of a high temperature flange joint having spacer plates incorporating ant-rotation tabs, according to a further embodiment.

In a further embodiment, as shown in FIG. 7, an additional anti-rotation feature may be realized by providing each spacer plate 42 (generically referring to either of the spacer plates 42*a*, 42*b*) with anti-rotation tabs contacting a top surface 60 of the respective flange 34 (generically referring to either of the flanges 34*a*, 34*b*). In case of the illustrated flange joints 30*a*, 30*b*, 30*c*, the top surface is a radially outer surface of the respective flange 34*a*, 34*b*. In the shown configuration, each spacer plate 42 is provided with a pair of anti-rotation tabs 72, 74 located respectively at a first lengthwise end 76 and a second lengthwise end 78 of the spacer plate 42. The tabs 72, 74 overlap and bear against the top surface 60 of the flange 34 to prevent rotation of the spacer plate 42 relative to the flange 34.

A further aspect of the present disclosure may be directed to a method for coupling a first component to a second component in a gas turbine engine, in accordance with the herein described embodiments. In one embodiment, the method may be part of servicing the gas turbine engine, including, for example, a replacement or upgrade of an existing flange joint.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A high temperature flange joint for coupling a first component to a second component in a gas turbine engine, comprising:

a first flange formed on the first component abutting a second flange formed on the second component, a plurality of adjacently arranged bolt connections, each bolt connection being formed through a pair of mutually aligned bolt holes in the first and second flanges, each bolt connection comprising:

a first spacer plate bearing against the first flange and a second spacer plate bearing against the second flange, a first lock washer and a second lock washer bearing against the first spacer plate and the second spacer plate respectively, a bolt inserted through the first and second flanges, the first and second spacer plates and the first and second lock washers, the bolt being preloaded to clamp the first flange to the second flange, each of the spacer plates having a respective thickness and being sized to enhance a bearing surface in contact with the respective flange, whereby a bolt preload is maintained during operation of the gas turbine engine, wherein the first and second flanges have a scalloped profile along a length direction, comprising first portions having a first height separated by second portions having a second height, the first height being greater than the second height, wherein the bolts are located at the first portions of the scalloped profile.

2. The high temperature flange joint according to claim 1, wherein the first and second flanges are formed of a material having a lower yield strength than a material of the spacer plates.

3. The high temperature flange joint according to claim 1, wherein each of the spacer plates is sized such that a bearing surface of the spacer plate substantially covers a bearing face of the respective flange along a length of the spacer plate.

4. The high temperature flange joint according to claim 1, wherein the lock washers are configured to utilize the bolt preload to secure the bolt in position.

5. The high temperature flange joint according to claim 1, wherein each spacer plate is sized to accommodate multiple adjacent bolts therethrough.

6. The high temperature flange joint according to claim 1, wherein each spacer plate extends lengthwise along the respective flange from a first edge to a second edge, the first edge and the second edge being beveled and configured to interface with beveled edges of adjacent spacer plates on opposite sides.

7. The high temperature flange joint according to claim 6, wherein the first and second edges are beveled in opposite directions.

8. The high temperature flange joint according to claim 1, wherein each spacer plate extends lengthwise along the respective flange from a first edge to a second edge, the first edge defining a groove shape and the second edge defining a tongue shape, the first and second edges being configured to form respective interlocking interfaces with tongue and groove shaped edges of adjacent spacer plates on opposite sides.

9. The high temperature flange joint according to claim 1, wherein each spacer plate is provided with a plurality of anti-rotation tabs contacting a top surface of the respective flange.

10. The high temperature flange joint according to claim 9, wherein the plurality of anti-rotation tabs include a first and a second anti-rotation tab located at a first lengthwise end and a second lengthwise end of the spacer plate respectively.

11. The high temperature flange joint according to claim 6, wherein each of the spacer plates is sized to accommodate a single bolt therethrough.

12. An exhaust diffuser in a turbine engine, comprising:

a first component and a second component, and a high temperature flange joint for coupling the first component to the second component, the high temperature flange joint comprising:

a first flange formed on the first component abutting a second flange formed on the second component, a plurality of adjacently arranged bolt connections, each bolt connection being formed through a pair of mutually aligned bolt holes in the first and second flanges, each bolt connection comprising:

a first spacer plate bearing against the first flange and a second spacer plate bearing against the second flange, a first lock washer and a second lock washer bearing against the first spacer plate and the second spacer plate respectively, a bolt inserted through the first and second flanges, the first and second spacer plates and the first and second lock washers, the bolt being preloaded to clamp the first flange to the second flange, each of the spacer plates having a respective thickness and being sized to enhance a bearing surface in contact with the respective flange, whereby a bolt preload is maintained during operation of the gas turbine engine, wherein the first and second flanges have a scalloped profile along a length direction, comprising first portions having a first height separated by second portions having a second height, the first height being greater than the second height, wherein the bolts are located at the first portions of the scalloped profile.

13. The exhaust diffuser according to claim 12, wherein the first component and the second component are coupled axially and defining a boundary of an annular exhaust flow path, the first and second flanges being annular in shape, wherein the bolt connections are adjacently arranged along a circumferential direction.

14. The exhaust diffuser according to claim 12, wherein the first component and the second component are coupled tangentially, the first and second flanges extending lengthwise in an axial direction, wherein the bolt connections are adjacently arranged along the axial direction.

15. A method for coupling a first component to a second component in a gas turbine engine, comprising:

forming a plurality of adjacently arranged bolt connections, each bolt connection being formed through a pair of mutually aligned bolt holes respectively in a first flange of the first component and a second flange of the second component, forming each bolt connection comprising:

disposing a first spacer plate bearing against the first flange and a second spacer plate bearing against the second flange, disposing a first lock washer and a second lock washer bearing against the first spacer plate and the second spacer plate respectively, inserting a bolt through the first and second flanges, the first and second spacer plates and the first and second lock washers, and preloading the bolt to clamp the first flange to the second flange, wherein each of the spacer plates has a respective thickness and is sized to enhance a bearing surface in contact with the respective flange, whereby a bolt preload is maintained during operation of the gas turbine engine, wherein the first and second flanges have a scalloped profile along a length direction, comprising first portions having a first height separated by second portions having a second height, the first height being greater than the second height, wherein the bolts are located at the first portions of the scalloped profile.

16. The method according to claim 15, wherein the first and second flanges are formed of a material having a lower yield strength than a material of the spacer plates.

17. The method according to claim 15, wherein each of the spacer plates is sized such that a bearing surface of the spacer plate substantially covers a bearing face of the respective flange along a length of the spacer plate.

18. The method according to claim 15, wherein the lock washers are configured to utilize the bolt preload to secure the bolt in position.

* * * * *